US006783575B2

(12) United States Patent
Pasic et al.

(10) Patent No.: US 6,783,575 B2
(45) Date of Patent: Aug. 31, 2004

(54) MEMBRANE LAMINAR WET ELECTROSTATIC PRECIPITATOR

(75) Inventors: Hajrudin Pasic, Athens, OH (US); M. Khairul Alam, Athens, OH (US); David J. Bayless, Athens, OH (US)

(73) Assignee: Ohio University, Athens, OH (US)

( * ) Notice: Subject to any disclaimer, the term of this patent is extended or adjusted under 35 U.S.C. 154(b) by 0 days.

(21) Appl. No.: 10/434,680

(22) Filed: May 9, 2003

(65) Prior Publication Data

US 2003/0217642 A1 Nov. 27, 2003

Related U.S. Application Data

(60) Provisional application No. 60/378,969, filed on May 9, 2002.

(51) Int. Cl.[7] ..... B03C 3/16

(52) U.S. Cl. ..... 96/44; 96/45; 96/60; 96/75; 96/79; 96/98

(58) Field of Search ..... 96/44, 45, 60, 96/66, 69, 75–79, 98

(56) References Cited

U.S. PATENT DOCUMENTS

| | | | | | |
|---|---|---|---|---|---|
| 4,035,886 | A | | 7/1977 | Gluck | 445/67 |
| 4,058,377 | A | | 11/1977 | Schminke et al. | 96/93 |
| 4,189,308 | A | * | 2/1980 | Feldman | 95/75 |
| 4,239,514 | A | | 12/1980 | Junkers | 96/87 |
| 4,276,056 | A | | 6/1981 | Pasic et al. | 95/76 |
| 4,321,067 | A | | 3/1982 | Gupner et al. | 96/74 |
| 4,553,987 | A | * | 11/1985 | Artama et al. | 96/44 |
| 5,137,546 | A | * | 8/1992 | Steinbacher et al. | 95/71 |
| 5,160,510 | A | * | 11/1992 | Steinbacher et al. | 95/64 |
| 5,626,652 | A | | 5/1997 | Kohl et al. | 96/45 |
| 5,759,240 | A | | 6/1998 | Becker | 96/86 |
| 6,231,643 | B1 | | 5/2001 | Pasic et al. | 95/75 |

FOREIGN PATENT DOCUMENTS

| | | | | |
|---|---|---|---|---|
| JP | 6-55099 | * | 3/1994 | 95/75 |

* cited by examiner

*Primary Examiner*—Richard L. Chiesa
(74) *Attorney, Agent, or Firm*—Jason H. Foster; Kremblas, Foster, Phillips & Pollick

(57) ABSTRACT

A laminar flow, wet electrostatic precipitator (ESP) with planar collecting electrodes preferably made of membranes, such as a woven silica fiber. The collecting electrodes are spaced close to planar discharge electrodes to promote laminar flow (Re<2300). Charging electrodes are positioned upstream of the wet ESP to charge the particulate entering the wet ESP to promote collection. The wet ESP is preferably downstream from a conventional turbulent dry ESP for collecting a substantial portion of the larger particulate in the gas stream prior to the gas stream entering the wet ESP.

10 Claims, 3 Drawing Sheets

| | Voltage (kV) | Current (mA) |
|---|---|---|
| **Stainless wire** | | |
| 1 | 10.0 | 0.20 |
| 2 | 12.5 | 0.45 |
| 3 | 15.0 | 0.70 |
| 4 | 16.0 | 0.90 |
| 5 | 17.0 | 1.1 |
| 6 | 18.0 | 1.2 |
| 7 | 18-20 | (Sparkover) |
| **Galvanized** | | |
| 1 | 10.0 | 0.05 |
| 2 | 12.5 | 0.09 |
| 3 | 15.0 | 0.1 |
| 4 | 16.0 | 0.12 |
| 5 | 17.0 | 0.20 |
| 6 | 18.0 | 0.25 |
| 7 | 19.0 | 0.35 |
| 8 | 20.0 | 1.00 |
| 9 | 20-21 | (Sparkover) |
| **Perforated Sheet Metal** | | |
| 1 | 10.0 | 0.05 |
| 2 | 12.5 | 0.15 |
| 3 | 15.0 | 0.25 |
| 4 | 16.0 | 0.35 |
| 5 | 17.0 | 0.60 |
| 6 | 18.0 | 0.80 |
| 7 | 18-20 | (Sparkover) |

FIG. 4

MEMBRANE LAMINAR WET ELECTROSTATIC PRECIPITATOR

This application claims the benefit of Provisional application No. 60/578,969 filed May 9, 2002.

BACKGROUND OF THE INVENTION

1. Field of the Invention

This invention relates generally to electrostatic precipitators (ESPs) used to precipitate particulate matter from exhaust gases onto collection substrates by electrostatic charge, and more particularly to a laminar flow, wet membrane collecting electrode ESP.

2. Description of the Related Art

Industrial ESPs are used in coal-fired power plants, the cement industry, mineral ore processing and many other industries to remove particulate matter from a gas stream. ESPs are particularly well suited for high efficiency removal of very fine particles from a gas stream. Specially designed ESPs have attained particle collection efficiencies as high as 99.9%. However, conventional ESP collection efficiencies are at their lowest values for fine particle sizes between 0.1–1.0 $\mu$m. Additionally, conventional ESPs cannot address the problem of gaseous emissions or gas-to-particle conversion.

In 1997 the Environmental Protection Agency (EPA) proposed new air quality standards for fine particulate matter. The focus of the regulations is the emissions of fine particulate, i.e., particles below 2.5 $\mu$m in aerodynamic diameter (PM2.5). These fine particulates are a health danger, because the human body cannot prevent these small particles from entering the respiratory tract and lungs.

In a typical conventional ESP, vertical wire electrodes are placed in the midsection of a channel formed between vertical parallel collector substrates. The heavy, typically steel, plates are suspended from a support structure that is anchored to an external framework. Commonly, ten or more of the single precipitation channels constitute a field. Industrial precipitators have three or more fields in series. An example of such a structure is shown and described in U.S. Pat. Nos. 4,276,056, 4,321,067, 4,239,514, 4,058,377, and 4,035,886, which are incorporated herein by reference.

A DC voltage of about 50 kV is applied between the wire electrodes (discharging electrodes) and the grounded substrate collector plates (collecting electrodes), inducing a corona discharge between them. A small fraction of ions, which migrate from the wires toward the plates, attach to the dust particles in the exhaust gas flowing between the plates. These particles are then forced by the electric field to migrate toward, and collect on, the plates where a dust layer is formed.

In dry ESPs, the dust layer is periodically removed from dry ESPs by hammers imparting sharp blows to the edges of the plates, typically referred to as "rapping" the plates. When ESPs are rapped, the dust layer is supposed to drop vertically downward from the plates due to a shear force between the plate and the parallel dust layer. The compressive loading in this so-called normal-rapping mode generates fast propagating stress waves, along and across the plate, that are manifested in large lateral amplitude displacements of the plates in the direction perpendicular to the plane of the plate.

Pasic et al., in U.S. Pat. No. 6,231,643, which is incorporated herein by reference, first disclosed the principle of using a membrane as a collecting electrode in a dry or a wet ESP in order to avoid the large deflection of the electrode due to rapping. However, the turbulent flow of gases around the membrane electrodes prevented substantial collection of acid aerosols and fine particulate.

Control of fine particulate and acid aerosols are of vital importance to the burning of coal that is inherently high in sulfur. The higher the sulfur content, the higher the $SO_3$ content, and therefore, the more likely that sulfuric acid aerosol formation will occur, especially in units that use selective catalytic reduction (SCR) for NOx control. The resulting opacity from the acid aerosols has caused plants to reduce their output during these exceedances.

Current particulate control devices, such as precipitators and bag filters, have problems with collection of fine particulate and acid gases, which later form aerosols known as secondary PM 2.5. Effective collection of submicron particles with bag filters is inherently difficult and creates unacceptably large pressure drops across the filter. ESPs have a particularly difficult time collecting particles in the size range of 0.1–1.0 $\mu$m, because the two dominant modes of particle charging, field and diffusion, go through combined minimums in this size range, and because particle charge depends on the strength of the electric field. In dry precipitators corona current and electric field strength is suppressed as the electrically resistive ash layer builds on the collecting surfaces. This effect can even lead to formation of back corona in dry precipitators.

The control of $NO_x$ emissions using selective catalytic reduction (SCR) technology is likely to aggravate $SO_3$ emissions at existing coal-fired power plants. Several plants with SCRs have experienced catalytic oxidation of $SO_2$ to $SO_3$. $SO_3$ vapor, in combination with water vapor, converts to gaseous sulfuric acid. When $SO_3$ vapor reaches saturation upon cooling or in contact with water, aerosols of fine sulfuric acid mist are formed. Most of these aerosols reside in a particle size range between 0.1 and 0.5 $\mu$m. At these sub-micron particle sizes the light scattering phenomenon is also at a maximum. This will result in a highly visible plume even for relatively small amounts of sulfuric acid aerosols. The resulting opacity can lead to temporary de-ratings of units, costing the plant potential sales.

A conventional ESP operates with turbulent flow in the gas channels. Because of the turbulent eddies, 100% collection efficiency is approached only asymptotically and cannot be attained no matter how large the precipitator. One theory that has been commercialized for dry precipitators to address their inherent problems with fine particulate collection is the use of laminar flow in precipitation. In laminar flow the flow streamlines are parallel and in the direction of flow, and therefore, there are no turbulent forces causing particles, especially fine particles, near the collecting surface to be blown back into the central flow region. Therefore, 100% collection efficiency is possible in laminar flow.

To create laminar flow, as is known, the Reynolds number (Re) must first be less than 2300 where $$\mathrm{Re} = \frac{V_{gas}\rho_g D_h}{\mu_g}$$

where $D_h$ is the hydraulic diameter defined by $$D_h = \frac{2(\Delta x)H}{\Delta x + H}$$

where $\Delta_x$ is plate spacing and H is the height of the collection electrode.

Reducing gas velocity to attain Re<2300 has been attainable since the first precipitator was built. However, laminar flow in ESPs is still prevented by the cross flow due to corona wind. The cross-flow caused by corona wind continuously disrupts the laminar flow conditions and creates a rebound effect from the solid collecting surfaces.

In 1998 Environmental Elements Corporation (EEC) overcame the problem of cross-flow caused by corona wind by using planar discharge electrodes with lower voltage, that are positioned much closer together than in conventional ESPs and have virtually no current flow. The idea behind a laminar flow precipitator is to vastly reduce the distance between the collection plates and as such, lower the Reynolds number below 2300, the generally accepted condition for transition to turbulent flow. Further, the plates must be smooth, as surface imperfections create disruptions of the boundary layer or induce turbulence outright. Both factors are employed to limit formation of turbulent flow.

The EEC device relies on upstream, turbulent flow electrostatic precipitator fields to remove 95+% of particulate in the gas stream and to charge all remaining particles before the particles reach the laminar region. However, the dry laminar precipitator in the EEC device fails to permanently collect particles. This is because, although the EEC device eliminates corona wind, it also eliminates the current flow that serves, in conventional ESPs, as the main adhesive force for cold-side precipitator ash. The current keeps a flow of charged particles striking the electrode to pin other particles onto the collector. In a dry precipitator, little collection can be done without corona to further charge and hold particles already collected in place by striking them with other charged particles. So while the EEC dry laminar precipitator was able to collect fine particulate with increased efficiency, the majority of particles were rapidly re-entrained due to the moving gas stream and the lack of current flow.

In the process of initial collection on the laminar EEC device, smaller particles temporarily attach to the collecting surfaces, and, through collision, the particles connect to each other, forming larger particles due to agglomeration. Without current flow, and thus with low adhesive forces, the larger particles re-entrain into the gas flow. A downstream conventional, turbulent precipitator field collects the larger particles, which become easier to collect due to their increased size. The invention has now been marketed as the Fine Particulate Agglomerator (FPA) and is discussed in U.S. Pat. No. 5,759,240 to Becker.

While dry electrostatic precipitation has been used in laminar arrangements, such as EEC's collector, it cannot be used collect acid aerosols unless the gas stream temperature is reduced below the acid dew point. This creates numerous problems in a dry environment, such as corrosion and wet-dry interfacings. Furthermore, another ESP is necessary downstream from the EEC device to collect the agglomerated particles. This consumes valuable, and possibly unavailable, space.

BRIEF SUMMARY OF THE INVENTION

The invention is an electrostatic precipitator for collecting matter from a flowing gas stream. The precipitator comprises at least one, and preferably a plurality of, substantially planar discharge electrodes disposed in the gas stream substantially parallel to the gas stream flow direction. The discharge electrodes have an electrical charge.

At least one, and preferably a plurality of, substantially planar collecting electrodes is disposed in the gas stream substantially parallel to the discharge electrodes, and alternated between the discharge electrodes. The collecting electrodes and the discharge electrodes are in such close proximity that the gas stream between the electrodes flows in a substantially laminar manner.

The collecting electrodes are made of a substantially water-saturated porous membrane having a water-wetted, exterior surface. The collecting electrodes have an electrical charge that is opposite in polarity to the electrical charge of the discharge electrodes. This thereby forms an electric field between the electrodes to cause particulate matter from the gas stream to be precipitated onto the collecting electrode during operation. The water serves as both a conductor and a trap for the matter that is collected.

In a preferred embodiment, at least one, and preferably a plurality of, charging electrodes are disposed in the gas stream upstream of the collecting electrode for charging some of the matter in the gas stream before the matter flows between the collecting and discharge electrodes.

The invention is capable of removing acid aerosols, soot, and ultrafine particles with no complicated scraping hardware, special seals, or secondary collection equipment. The ash layer in the laminar wet ESP does not create an insulating effect in the water on the membrane, and therefore there is no corona current and electric field strength suppression. The use of continuously wetted collecting electrodes also minimizes the formation of back corona. This is because the wet ESP has constantly wetted and cleaned surfaces, and because water that contains ions, and is uniformly distributed via capillary transport, is an excellent conductor. Therefore, the wet precipitator can deliver far greater energizing power due to higher voltages and field strengths, and can effectively charge even submicron particles. Testing by the inventors of aerosol and particulate collection using a bench-scale laminar wet precipitator has indicated that both re-entrainment of collected aerosols and particulates is eliminated, but also that uniform field strengths of 400 kV/m are possible without the onset of corona if the correct electrode configuration and materials are used. These field strengths are equal to, or higher than, the typical turbulent dry precipitator.

The potential of membrane-based wet precipitation to control acid aerosols, condensed hydrocarbons and soot, and fine and ultra-fine particles is very good. The continual wetting action via capillary flow and flow along the outer surface causes water to act as both the collecting electrode and the cleaning mechanism to prevent back-corona and loss of collection efficiency. In addition, the use of water as a collector eliminates re-entrainment because the collected particle "sticks to" or is absorbed by the water with forces much stronger than the transport effects of bulk gas flow. Once the particle is collected, it will not be re-entrained as seen in dry precipitators By using water, two main advantages are gained. First, because of the high degree of adhesion between water and solid particles, any particle reaching the collecting surface will be held, without re-entrainment, and carried away with the water. The water in the laminar wet ESP collects and removes particles collected at near 100% efficiency through attainment of laminar flow in a very high voltage field. Second, because of the large volume of water in this field and the close proximity of the electrodes, the gas stream temperatures will be reduced to below the dew point for most of the gases, condensing acid gases and creating acid aerosols. These aerosols can then be collected in the water on the collecting membranes, which may be in one of numerous configurations, but must be wet.

Because the invention is a wet system, potential applications include, but are not limited to vertical flow uses, such as immediately downstream of a wet scrubbing (for $SO_2$ control) system to act to remove acid aerosol and water mist, or as a last field in a horizontal flow (hybrid) precipitator, where the laminar wet precipitator acts as a polishing unit, or as an entirely separate polishing unit that follows some other bulk particulate removal device.

BRIEF DESCRIPTION OF THE SEVERAL VIEWS OF THE DRAWINGS

FIG. 4 is a table containing experimental results of a plurality of materials used as discharge electrodes.

Figure 1:
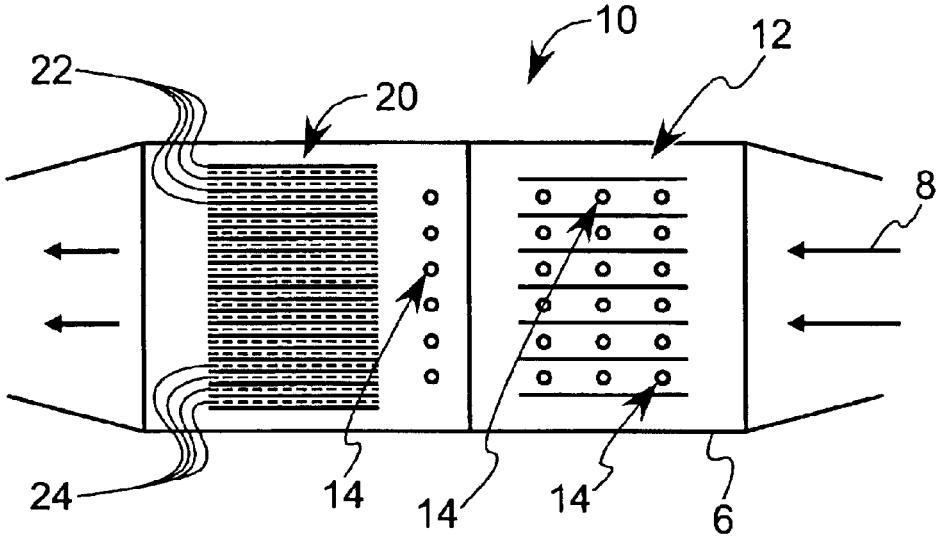
FIG. 1 is a schematic view illustrating the present invention in a flue in a configuration relative to a dry, turbulent ESP.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

An embodiment of the present invention is shown in FIG. 1, in which a hybrid precipitator 10 is shown having a dry ESP field 12 in the path 8 of the gas containing particulate and other matter. The dry ESP 12 is a conventional electrostatic precipitator that collects a large percentage of the particulate in the gas stream 8. Downstream from the dry ESP field, charging electrodes 14 extend across the path of the gas to pre-charge the matter in the gas. Downstream from the charging electrodes, a wet ESP 20 is disposed in the gas stream.

The wet ESP 20, which can be used in a horizontal or a vertical flow flue, includes grounded collecting electrodes 22 and high-voltage discharge electrodes 24. The collecting electrodes 22 are planar and substantially parallel to the direction of flow of the gas stream 8 flowing through the wet ESP 20. Between each pair of collecting electrodes 22 is a substantially parallel discharge electrode 24, and a space of about 3 to 5 cm is formed between each adjacent electrode. The preferred spacing is 3.0 cm, although larger spacing is possible if the gas stream velocity is reduced accordingly to maintain laminar flow. Thus, the collecting electrodes 22 alternate with the discharge electrodes 24 across the housing 6 through which the gas stream 8 flows. The housing 6 is the flue through which the gas stream flows to enter the environment. However, the term "flue" is intended to include any housing through which the gas stream flows.

All electrodes in the wet ESP 20 region are substantially parallel to one another and to the flow of the gas stream 8. Because of the dimensions and shapes of the electrodes, the velocity of the gas and the spacing between electrodes, among other variables, the flow of gas through the wet ESP is substantially laminar, i.e., the Reynolds number is less than or equal to 2300. It is preferred that the Reynolds number be less than 2000.

Figure 2:
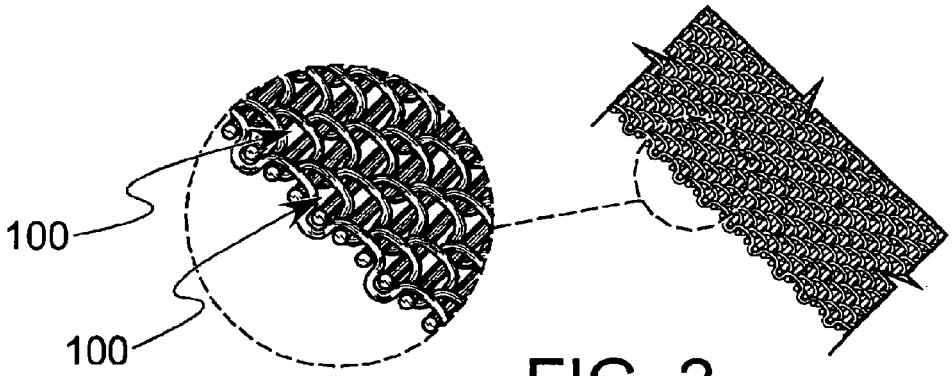
FIG. 2 is a schematic view illustrating a contemplated collecting electrode membrane.

Each collecting electrode is made of a woven or non-woven fiber, a combination of particulate and binder, a sponge or some other configuration that is porous. A collecting electrode is shown in FIG. 2. The term "porous" is defined herein to mean that it has pores or passages through the structure that permit water to flow throughout. For example, the pores 100 between the fibers in FIG. 2. In the preferred embodiment, the electrode is a woven fiber material that has small pores and passages between the fibers through which water can flow in various directions, although in the preferred embodiment the water flows preferentially along the fibers' longitudinal axes. The passages of water through the electrode are necessary, because the water forms the conductive part of the electrode in the embodiment, and must therefore be able to flow through the electrode.

The material of each collecting electrode also has a "water-wettable" composition, i.e., a chemical composition that permits water to wet it enough that water can flow along the exterior surfaces of it without substantial beading, flow paths and dry spots. The flow of water on the exterior surfaces of the electrode, which is limited to a small amount, is necessary to carry ash particulate away to prevent caking of any ash on the exterior surface. The ash that is carried away is disposed of in a conventional manner.

The preferred collecting electrodes are made of fibrous or woven membrane material such as carbon or silica fibers, or a stainless steel mesh that does not absorb water or change its fiber spacing when water is present between the fibers. A most preferred material for use as a collecting electrode is a woven silica fiber membrane, such as is sold under the trademark OMNISIL. Alternatively, the collecting electrode can be made of a polyester material, such as is sold under the trademark CONDUCTO by GKD, a German company that has an American affiliate in Maryland. In all cases, the membranes are made of non-corrosive materials suitable for implementation of technologies that could be used in burning high-sulfur coals. The collection surfaces, while wet, can be rotating or stationary. The collecting electrodes do not have to be made of exemplary conductive materials, because the water is the conductor.

The wet laminar precipitator is preferably downstream of one or more dry ESP fields, which substantially reduce the particulate concentrations in the gas stream before it reaches the wet laminar ESP. The dry ESP removes the bulk of the particulate, leaving the fine and ultrafine particles and aerosols for removal by the wet laminar precipitator. It is thus preferred that the wet laminar ESP be the last collecting device in the gas stream. By reducing the amount of particulate in the laminar wet ESP, corona suppression by the particulate is reduced, and significant fouling of the collecting surfaces is avoided. Additionally, the sludge control problem after collection is minimized.

As described above, immediately upstream of the laminar flow wet ESP, high voltage corona is applied to charge the remaining particulate by a bank of high corona producing charging electrodes that sufficiently charge incoming particles. This high power throughput charging section ionizes the gas stream and charges the particles before the gas stream enters the wet laminar ESP. In the laminar field, planar high voltage electrodes will provide an electric field, but no ionization (corona). Therefore, upstream particle charging is necessary.

The flow will not make a sudden transition from turbulent to laminar. The flow should transition to laminar over an entrance length of $$\frac{\mathrm{Re}\cdot\Delta x}{30}$$

(or approximately 2 m for the typical embodiment). Therefore, to achieve laminar flow, either sufficient length of the laminar section is required, or flow straightening devices upstream of the laminar field are necessary.

It is possible to have no dry ESP or other collecting device upstream of the laminar wet ESP. Such a collecting system would have only charging electrodes just upstream of the laminar flow wet ESP. However, by eliminating the upstream collection, a much more significant amount of particulate will have to be removed by the wet laminar ESP, which will require greater water flow to prevent caking of the ash on the exterior surface of the collecting electrodes.

Figure 3:
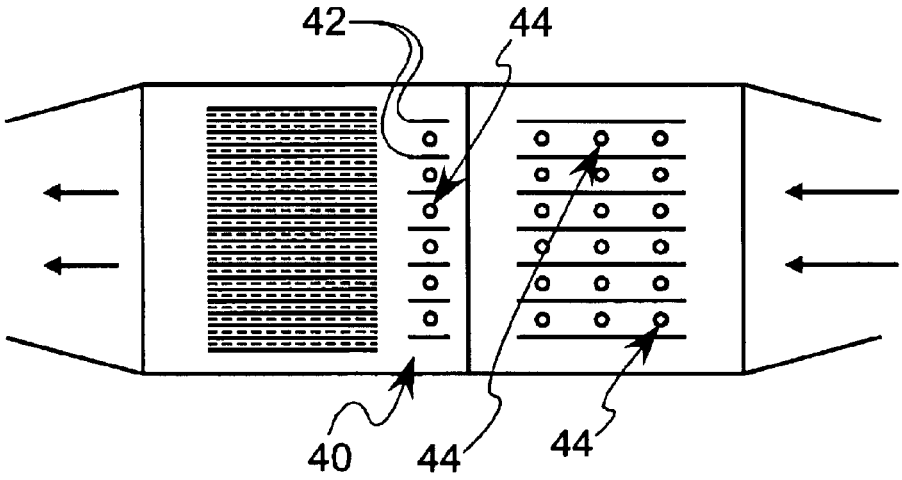
FIG. 3 is a schematic view illustrating the present invention in a flue in an alternative configuration relative to a dry, turbulent ESP.

As an alternative to the embodiment shown in FIG. 1, the embodiment shown in FIG. 3 can be used. The substantive difference between the two embodiments is the use of a wet charging field 40 upstream of the wet laminar ESP field 60 including the charging electrodes 44 rather than the charging electrodes 14 alone as shown in FIG. 1. The purpose of the wet collecting or grounding plates 42 in the charging field 40 is not to collect particles, but to charge particles prior to entry into the laminar wet ESP 60. Electric field strength, a major factor in particle charging, requires a completely grounded circuit. Otherwise, back corona is a possibility, reducing charging. Greater power levels can be delivered in the upstream charging fields using the wet grounding plates, charging even submicron particles to a level suitable for capture.

As noted above, there is laminar flow (Re<2300) between the collecting and discharge electrodes in the wet ESP 60. Because of the close proximity of the electrodes to one another, the electric field has a charge per unit length that is equal to, or greater than, the charge in dry ESPs, but without the corona. Because of their close proximity and the laminar flow of the gas therebetween undisturbed by corona wind, the electrodes collect essentially all particulate and aerosol acids that flow through the electric field. And there is virtually no current flow that permits the particles to re-entrain. This combination of laminar gas flow, no current flow, wet collecting electrodes and strong electric field is not found in any existing ESP.

The reduction of turbulence greatly promotes collection efficiency. Due to the laminar nature of the flow, the depth of the field can be greatly reduced and still achieve nearly 100% collection efficiency for many submicron particles. The Reynolds number is maintained below the Schlichting stability criteria so perturbations are damped. While this requires the cross-sectional area of flow to be about twice that of a turbulent precipitator, the footprint would not have to be twice the size, as the vertical component could be significantly increased.

The inventors have built a wet laminar ESP test section with multiple collecting electrodes spaced 3.0 cm from the adjacent discharge electrodes to capture $SO_3$ and sub-micrometer particulate loaded at approximately 10% of the concentration typical to the inlet of a precipitator at a coal-fired power plant. The 10% number was used, because it was assumed that with dry ESPs upstream, 90% of sub-micrometer particles would be captured. No upstream spraying occurred, although upstream corona-generating charging electrodes were used, and gas temperatures prior to the test section were above the acid gas dew point. Existing equipment was used to provide the inlet gas and particulate concentrations, as well as to measure $SO_3$ levels.

Experimentation has demonstrated uniform high field strengths, and elimination of re-entrainment, when using the wet laminar ESP. No additional fields are necessary downstream of the invention, as the water on the collecting electrodes completely eliminates particulate re-entrainment. For the experimental units using an applied voltage of 11 kV to the collecting and discharge electrodes, with spacing at 0.03 m, collection was, within experimental detection limits, 100%, even for particles as small as 0.5 $\mu$m in diameter. Collection efficiency could easily be improved by increasing electrode voltage or increasing the field depth, which is collecting electrode length in the direction of flow, or by reducing flow velocity even fractionally.

Typical problems of wet precipitation have also been considered in the design of the invention. For example, droplet detachment seen in hybrid ESPs with sheeting flow of water on the collecting electrode is eliminated because sheeting flow on the collecting electrodes of the invention is not needed or desired during normal operation. Sheeting flow is only necessary on the rare occasion to flush the membrane collecting electrodes. During normal operation, just enough water is provided to saturate the fibers without creating wet-dry interface problems: approximately 0.1 gallons per minute per linear foot in the direction of gas flow for OMNISIL. With too much surface flow, water particles can begin to separate off into the gas, and the gas can become excessively humidified. Even during flushing, experimental testing indicates that if field strength is reduced to about 60%, which is still highly effective for collection, no droplet detachment is observed. This eliminates the problem of wet-dry interfaces experienced at Mirant's Dickerson station.

Figure 6:
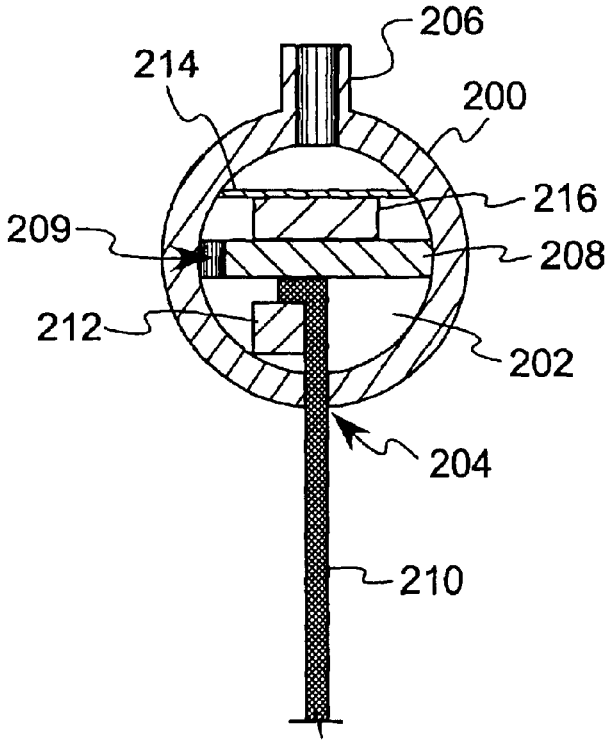
FIG. 6 is an end view in section illustrating one embodiment of a water supply for the collecting electrode.

A preferred embodiment of the mechanism that supports the membrane collecting electrode and injects water into the membrane collecting electrode is shown in FIG. 6. A pipe 200, which is preferably a conventional PVC pipe, has a longitudinal passage 202 extending therethrough. A longitudinal slot 204 is formed in the lower side of the pipe 200 and the collecting electrode 210 extends downward from the passage 202 out the slot 204 and into the gas stream beneath the pipe 200. A water inlet fitting 206 is fixed to the upper side of the pipe 200, and connects to a water supply (not shown) in a conventional manner to permit the supply of water to the chamber 202 of the pipe 200.

An elongated wall 208 is mounted in the chamber 202, and the electrode 210 is mounted thereto by being clamped between the wall 208 and the fastening strip 212, such as by screws that extend through the fastening strip 212 and the electrode 210 into the wall 208. The wall 208 seats at its lateral edges against the sidewall of the pipe 200, and has a plurality of apertures 209 through which water can flow freely.

The pressure shim 214, which is spaced from the wall 208 by the spacer 216, is a flexible strip with lateral edges that seat against the inner sidewall of the pipe 200. This forms a one-way valve that permits water coming through the fitting 206 to, with resistance, to the membrane 210. The pressure shim 214 bends under pressure to unseat from the pipe 200 sidewall to permit water to flow past it, thereby forming a valve that permits water to flow at a fixed rate to the electrode 210.

During operation, water flows into the fitting 206, past the pressure shim 214 at a fixed rate, through the apertures 209 and into the portion of the chamber 202 beneath the wall 208 in which the upper edge of the electrode 210 is fixed. The water flows through the pores and passages of the electrode 210, and on the outer surface of the electrode 210 through the slot 204, and falls under the force of gravity downwardly through and on the outer surface of the electrode 210.

Dry planar discharge electrodes are used in the laminar wet ESP. These planar discharge electrodes provide high voltage collection when used in conjunction with water injected between the fibers of the collecting membranes. In a preferred embodiment, the discharge electrodes are galvanized steel plates. The arrangement of collecting electrode surfaces and high voltage discharge electrodes are shown schematically in FIGS. 1 and 3.

Discharge electrodes are needed to produce an electric field in the absence of corona to minimize the formation of uv radiation and corona wind. Typical "spiked" type discharge electrodes, such as those used in the dry precipitator experiments, are designed to enhance corona, not minimize it. Therefore, a different type of discharge electrode had to be found by experimentation, which was carried out after testing to determine the best collecting electrode.

Four common membrane materials were tested in the planar discharge electrode testing apparatus, which contained two parallel collecting electrodes with a discharge electrode between them. The discharge electrode was uniformly spaced 3.8 cm from the grounded collecting electrodes. The materials used for the collecting electrodes included polypropylene, polyester, carbon fibers, and OMNISIL. The materials tested for the discharge electrodes included galvanized sheet metal and stainless steel with wide and fine meshes.

All materials tested as collecting electrodes, except OMNISIL, produced very high currents when they were wetted, which was in stark contrast to the "dry" results, which produced very high voltages and virtually no current. The highest attainable voltage, other than when using OMNISIL as a collecting electrode, that did not exceed current limits was found with polypropylene. Even with polypropylene, only 4 kV could be reached before an overcurrent condition occurred. Carbon fibers reached overcurrent at only 1.5 kV. However, the wet OMNISIL 600 material was found to produce minimal current up to 17 kV after removal of frayed fibers that drifted into the electrode gap.

Figure 5:
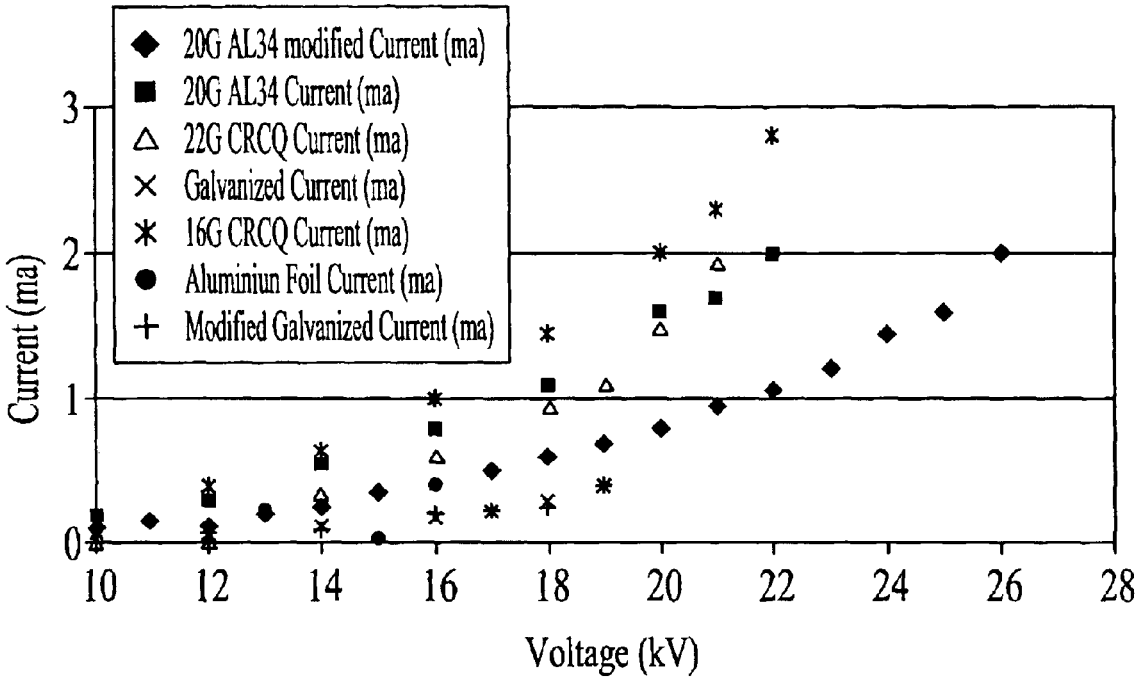
FIG. 5 is a graph of current versus voltage containing experimental results of a plurality of materials used as discharge electrodes.

After finding the best collecting electrode, several discharge electrode configurations were tested and their current production as a function of voltage is shown in the table of FIG. 1 and shown graphically in FIG. 5. While the final discharge electrode material has not been positively selected, testing with galvanized sheet metal provided suitable results of producing a strong field with low current.

Additional planar electrode tests were conducted with aluminum foil and "hollow" (also referred to as "modified") galvanized sheet metal that had large sections cut out from its center to reduce its weight. Wet uncoated OMNISIL was used as the membrane, at room temperature and with electrode-membrane spacing of 3.8 cm. The results are shown in FIG. 5. The planar galvanized sheet metal was determined to be the best discharge electrode tested for low current.

While certain preferred embodiments of the present invention have been disclosed in detail, it is to be understood that various modifications may be adopted without departing from the spirit of the invention or scope of the following claims.

What is claimed is:

1. A laminar flow, wet electrostatic precipitator for collecting matter from a gas stream flowing through a flue, the laminar flow, wet electrostatic precipitator comprising:

a) at least one substantially planar discharge electrode disposed in the gas stream substantially parallel to a direction of flow of the gas stream, the discharge electrode having an electrical charge;

b) at least one substantially planar collecting electrode disposed in the gas stream substantially parallel to the discharge electrode and close enough to the discharge electrode that a portion of the gas stream flowing between the electrodes has substantially laminar flow characteristics, the collecting electrode being made of a substantially water-saturated porous membrane having a water-wetted, exterior surface, the collecting electrode having an electrical charge that is opposite in polarity to the electrical charge of the discharge electrode, thereby forming an electric field between the electrodes to cause particulate matter from the gas stream to be precipitated onto the collecting electrode during operation; and c) at least one charging electrode disposed in the gas stream upstream of said at least one collecting electrode for charging at least some of the matter in the gas stream before the matter flows between the collecting and discharge electrodes.

2. The laminar flow, wet electrostatic precipitator in accordance with claim 1, wherein said at least one discharge electrode further comprises a plurality of discharge electrodes, wherein said at least one collecting electrode further comprises a plurality of collecting electrodes, and wherein said plurality of discharge electrodes is alternated with said plurality of collecting electrodes for interposing said collecting electrodes between adjacent discharge electrodes.

3. The laminar flow, wet electrostatic precipitator in accordance with claim 2, wherein said at least one charging electrode further comprises a plurality of charging electrodes spaced across the flue.

4. The laminar flow, wet electrostatic precipitator in accordance with claim 3, wherein the laminar flow, wet electrostatic precipitator is positioned downstream of a turbulent flow, dry electrostatic precipitator, said dry electrostatic precipitator being for removing a substantial portion of the matter in said gas stream before the gas stream reaches said laminar flow, wet electrostatic precipitator.

5. The laminar flow, wet electrostatic precipitator in accordance with claim 4, wherein the charging electrodes are discharge electrodes in said dry electrostatic precipitator.

6. The laminar flow, wet electrostatic precipitator in accordance with claim 3, wherein at least one wet, turbulent flow grounded electrode is disposed adjacent each of said charging electrodes.

7. The laminar flow, wet electrostatic precipitator in accordance with claim 4, wherein said collecting electrodes are made of woven silica fiber.

8. The laminar flow, wet electrostatic precipitator in accordance with claim 4, wherein said discharge electrodes are made of galvanized steel.

9. The laminar flow, wet electrostatic precipitator in accordance with claim 8, wherein apertures are formed in the discharge electrodes.

10. The laminar flow, wet electrostatic precipitator in accordance with claim 3, further comprising means for injecting water into said collecting electrodes.

* * * * *